US007152991B2

(12) United States Patent
Jines et al.

(10) Patent No.: US 7,152,991 B2
(45) Date of Patent: Dec. 26, 2006

(54) MAKE UP STATION

(75) Inventors: Michael D. Jines, Northfield, MN (US); Michael Smedstad, Owatonna, MN (US); Steven E. Wiese, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 99 days.

(21) Appl. No.: 10/786,464

(22) Filed: Feb. 25, 2004

(65) Prior Publication Data

US 2004/0196652 A1 Oct. 7, 2004

Related U.S. Application Data

(60) Provisional application No. 60/450,522, filed on Feb. 27, 2003.

(51) Int. Cl.
*F21V 33/00* (2006.01)

(52) U.S. Cl. ..... 362/135; 362/128; 362/129; 362/144

(58) Field of Classification Search ..... 362/147, 362/249, 135, 140, 142, 197, 128, 129; 359/874
See application file for complete search history.

(56) References Cited

U.S. PATENT DOCUMENTS

| | | | | |
|---|---|---|---|---|
| 2,313,838 | A | | 9/1941 | Nordquist |
| 3,059,103 | A | * | 10/1962 | Myerberg ..... 362/129 |
| 3,381,119 | A | | 4/1968 | Brickman et al. |
| 3,714,411 | A | | 1/1973 | Waters et al. |
| 3,757,103 | A | | 9/1973 | Walter |
| 3,794,828 | A | | 2/1974 | Aprino |
| 3,876,293 | A | | 4/1975 | Ramos |
| D264,414 | S | | 5/1982 | Missir |
| D292,652 | S | | 11/1987 | Muller et al. |
| 5,165,780 | A | * | 11/1992 | Katz ..... 362/147 |
| 5,359,461 | A | | 10/1994 | Rice et al. |
| 5,392,162 | A | * | 2/1995 | Glucksman ..... 359/872 |
| 5,725,295 | A | | 3/1998 | Moncourtois et al. |
| 6,347,876 | B1 | | 2/2002 | Burton |
| 6,382,802 | B1 | | 5/2002 | Goodman |
| D464,206 | S | | 10/2002 | Moncourtois et al. |

OTHER PUBLICATIONS

Printout of Internet website for "Cases for Visual Arts, Inc.—Affordable Makeup Stations".

* cited by examiner

*Primary Examiner*—Sandra O'Shea
*Assistant Examiner*—Anabel Ton
(74) *Attorney, Agent, or Firm*—Patterson, Thuente, Skaar & Christensen, P.A.

(57) ABSTRACT

A make up station provides even illumination for a performer's face while minimizing glare and distracting reflections. The make up station is modular to allow the easy assembly of multiple make up stations partially sharing common lighting between adjacent stations. Light rays emanating from the forward most edge of a light source are blocked by a raised trim or reflected from the mirror surface in a direction so that they do not impinge on the user's eye.

16 Claims, 6 Drawing Sheets

MAKE UP STATION

CLAIM TO PRIORITY

This application claims priority to U.S. Provisional application Ser. No. 60/450,522 entitled "Make up Station" filed on Feb. 27, 2003.

TECHNICAL FIELD

The present invention relates generally to lighting systems. More particularly, the present invention relates to a lighting system on a make up station especially adapted for use by performers to aid in the application of theatrical cosmetics.

BACKGROUND OF THE INVENTION

The costumes and cosmetics used by performers in theatrical and cinematic performances are complex and must be applied with care to obtain the desired visual effects on stage or under harsh lighting. Most theatrical actors and actresses prepare for performances backstage, where space is limited and lighting is often poor or nonexistent. Additionally, some theatrical production companies in better known venues or in television and movie productions will provide makeup artists for the actors. It is frequently difficult for these makeup artists to properly make up a large cast when they have limited space for their materials and little time before performances or between scenes to spend with each individual.

Lighted make up mirrors are known in the art but do not adequately address the unique difficulties faced in backstage areas. Some are small in size and are designed for personal home use. Others are bulky and require special stands that make the mirror less appropriate for a crowded and bustling backstage environment.

Conventional make up stations are generally custom-built, and often require the coordination of a number of different contractors to complete installation. Custom built make up stations require the labor of multiple tradeworkers to complete. To complete the construction of a custom built make up station requires at least a carpenter, a glazier and an electrician and often a cabinet maker and a countertop fabricator. Consequently, a custom built make up station can be expensive and time consuming to build and install.

In addition, the conventional design of a make up station includes a mirror surrounded by a row of incandescent lamps. Incandescent lamps are preferred for their warm color temperature which is similar to natural light and the lighting used in theater and cinematic production. In addition, incandescent lamps are inexpensive and readily available. Typically, lampholders are placed generally on the same plane as the mirror and the lamps themselves extend forward of the mirror. With this arrangement, images of the lamps are reflected in the mirror causing glare and the distracting presence of the bulb images in the periphery of the mirror.

Thus, there exists a need in the theatric and cinematic industries for a lighted make up station that is appropriate for backstage use and that can be supplied in an economical fashion. Further, it would be desirable if the make up station provided even illumination, with distracting reflections reduced or eliminated.

SUMMARY OF THE INVENTION

The make up station of the present invention substantially meets the needs of the industry as discussed above.

In one embodiment, the make up station of the present invention includes a mirror, a work surface, a reflective storage surface, an electrical and lighting system, and a reusable mounting surface. In this embodiment, the make up station can be mounted on a backstage wall for permanent use.

In a second embodiment, the make up station may be mounted immediately adjacent to other make up stations such that the lighting system is shared by adjacent make up stations. In another embodiment, the make up station may include a storage unit mounted below the work surface.

In a further embodiment, the make up station includes a mirror, an electrical and lighting system, and a portable station frame. The portable station frame further comprises a transport handle. In this embodiment, the make up station may be easily transported for use on location or in a temporary make up space while requiring minimal storage space when not in use.

The make up station of the present invention also places incandescent lighting in a location so that it cannot be seen in the periphery of the mirror and yet provides even illumination of a performer's face.

The periphery of the make up station both provides a support for lampholders to support lamps and also acts as a raceway for wiring for the light sockets, switches and a single or duplex outlet to accommodate the use of electrical appliances, such as curling irons and hair dryers, at the make up station.

DETAILED DESCRIPTION OF DRAWINGS

Figure 1:
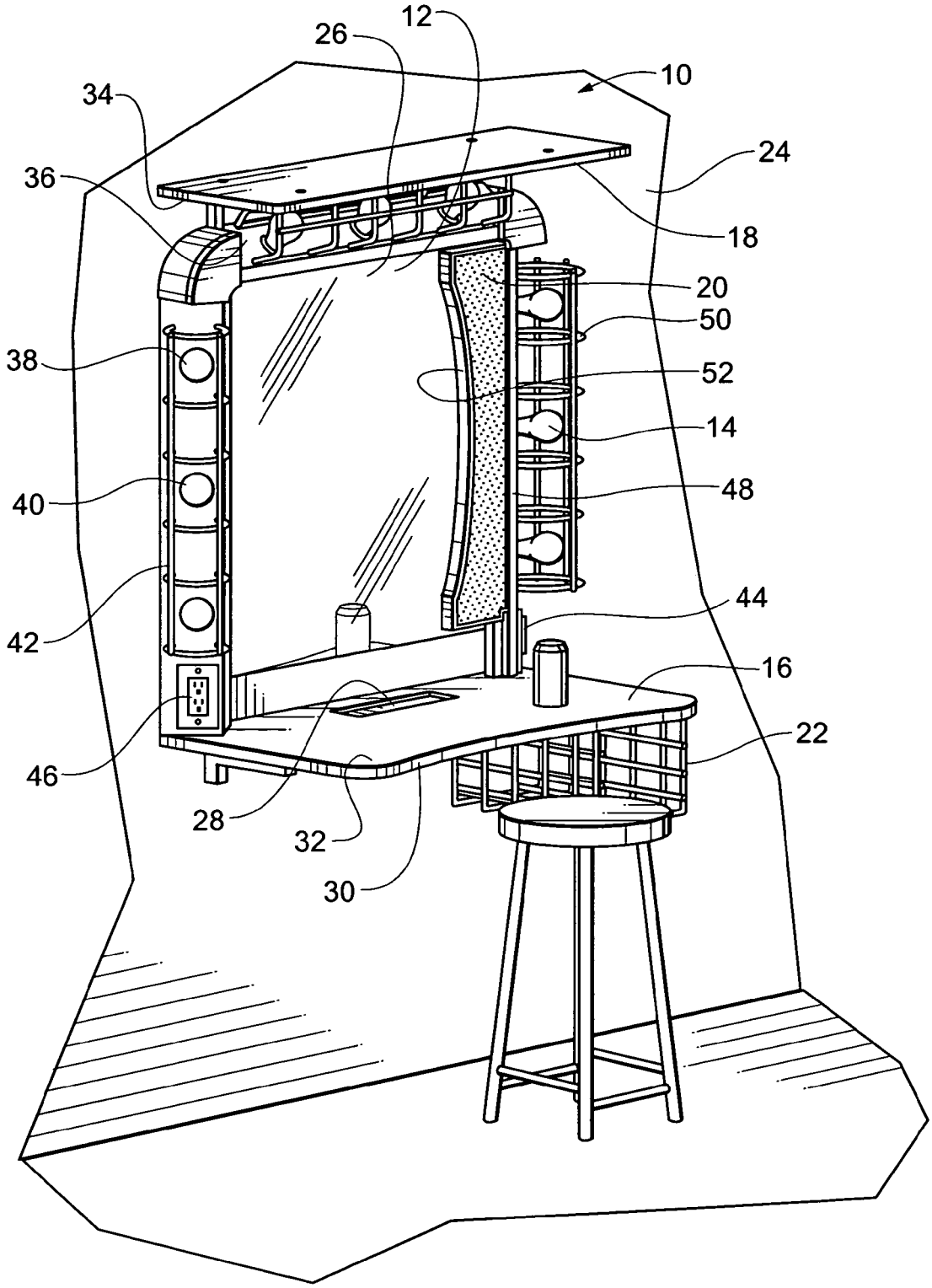
FIG. 1 is a perspective view of a make up station in accordance with the present invention installed on a supporting wall.

Referring to FIG. 1, the make up station 10 of the present invention includes mirror 12, electrical and light system 14, work surface 16, reflective storage surface 18, reusable mounting surface 20, and storage unit 22. The make up station 10 is depicted mounted on a supporting wall surface 24.

The mirror 12 is preferably about twenty-eight inches square but may be any size without departing from the spirit of the invention. The mirror 12 is shatter protected, for example, the mirrored surface 26 may be laminated to a plastic layer or a metal backer (not shown) that prevents shards from separating if the mirrored surface 26 is broken. Mirror 12 may also be tempered glass or shatter protected in other ways as well.

Work surface 16 is conveniently located about four inches below the mirror 12 and includes a concave front edge 30 to allow users to approach close to the mirror 12 while still allowing adequate workspace on the work surface 16. In one embodiment, the work surface 16 includes a trough 28 located immediately below the mirror 12 for holding make up pencils, brushes, or other small items. The work surface 16 is desirably formed from a matte white PVC laminate finish 32 over a wood core or wood product substrate (not shown) or other matte highly reflective diffusing surface to reflect light and not alter accurate color rendition. Finish 32 is also heat and stain resistant. The work surface 16 is designed to support up to a 300-pound load at any point. In one embodiment, the work surface 16 further comprises a storage unit 22 for out-of-the-way storage of large or infrequently used items. Storage unit 22 may include a drawer, bin or shelf situated under work surface 16.

Reflective storage surface 18 is preferably thirty-six inches wide and twelve inches deep but may be any other practical size without departing from the spirit of the invention. The storage surface 18 is intended to store wig boxes, infrequently used cosmetic or costume items, or other personal effects in a convenient yet out-of-the-way location. Undersurface 34 of the storage surface 18 comprises a matte white finish over a wood core (not shown), like that of the work surface 16, that enables it to reflect light uniformly to provide accurate color rendition. Undersurface 34 is also heat resistant.

The electrical and light system 14 preferably includes frame 36, lampholders 38, incandescent lamps 40, switch 44, and duplex outlet 46. There are preferably nine lampholders 38 with corresponding lamps 40 on a make up station 10. The lampholders 38 preferably project from frame 36 at about a forty-five degree angle. The angle of the lampholders 38 and lamps 40 allows adjacent make up stations 10 to share a vertical row of lampholders 38 and lamps 40. Further, this angle of the lampholders 38 and lamps 40 positions lamps 40 reduce glare from the lamps 40 reflected in the mirror 12. The lamps 40 are enclosed by steel wire cages 50, a National Electrical Code requirement. The wire cages 50 are positioned such that they protect lamps 40 from breakage and protect users from burns from hot lamps 40 while minimizing shadows cast upon a user's face when the user is using the make up station 10. This application depicts and describes the invention utilizing incandescent light bulbs for lamps 40. While this is a preferred option, it is to be understood that the invention contemplates the use of other types of light sources including but not limited to fluorescent tubes, light emitting diodes and halogen lamps.

Switch 44 is operable to control the lampholders and lamps 40, while the duplex outlet 46 provides electrical power for styling accessories such as hairdryers and curling irons. Duplex outlet 46 is, typically, not controlled by switch 44 so that duplex outlet 46 always supplies power Mirror 12 is recessed slightly into the front surface of make up station and surrounded by raised trim 48. Raised trim 48 largely shields lamps 40 from being imaged in mirror 12 thus minimizing or eliminating undesirable peripheral reflections and glare. Raised trim 48 may be an integral part of frame 36 or a separate part. Frame 36 forms a mirror surround and electrical raceway 42. Electrical raceway 42 is desirably formed of extruded aluminum. Electrical raceway 42 provides a convenient conduit for running and protecting electrical wiring associated with lampholders 38, switch 44, and duplex outlet 46 as well as supporting lampholders 38 at an angle to mirror 12 so that little or no reflected image of lamps 40 is visible to a viewer viewing his face in mirror 12.

The reusable mounting surface 20 can be cork board, a porcelainized steel surface ("whiteboard") or similar surface used to attach photos, papers, or similar items by tacks, magnets or other suitable removable fasteners, for easy viewing. The mounting surface 20 is preferably about six inches wide with a recessed concave edge 52 to maximize usable surface area on mirror 12. As depicted here, mounting surface 20 is shown on the right side of the mirror surface 18. However, mounting surface 20 is user-positionable and thus may be mounted on either side or on the top or bottom of the mirror surface 18 as is most convenient for an individual user.

Make up station 10 further includes a support frame 54 that is preferably welded steel. Make up station 10 further comprises a wall-mounting bracket (not shown) that is operable to mount the make up station 10 to a wall surface 24. The bracket (not shown) comprises a leveling provision and also allows for horizontal positioning adjustment.

Figure 2:
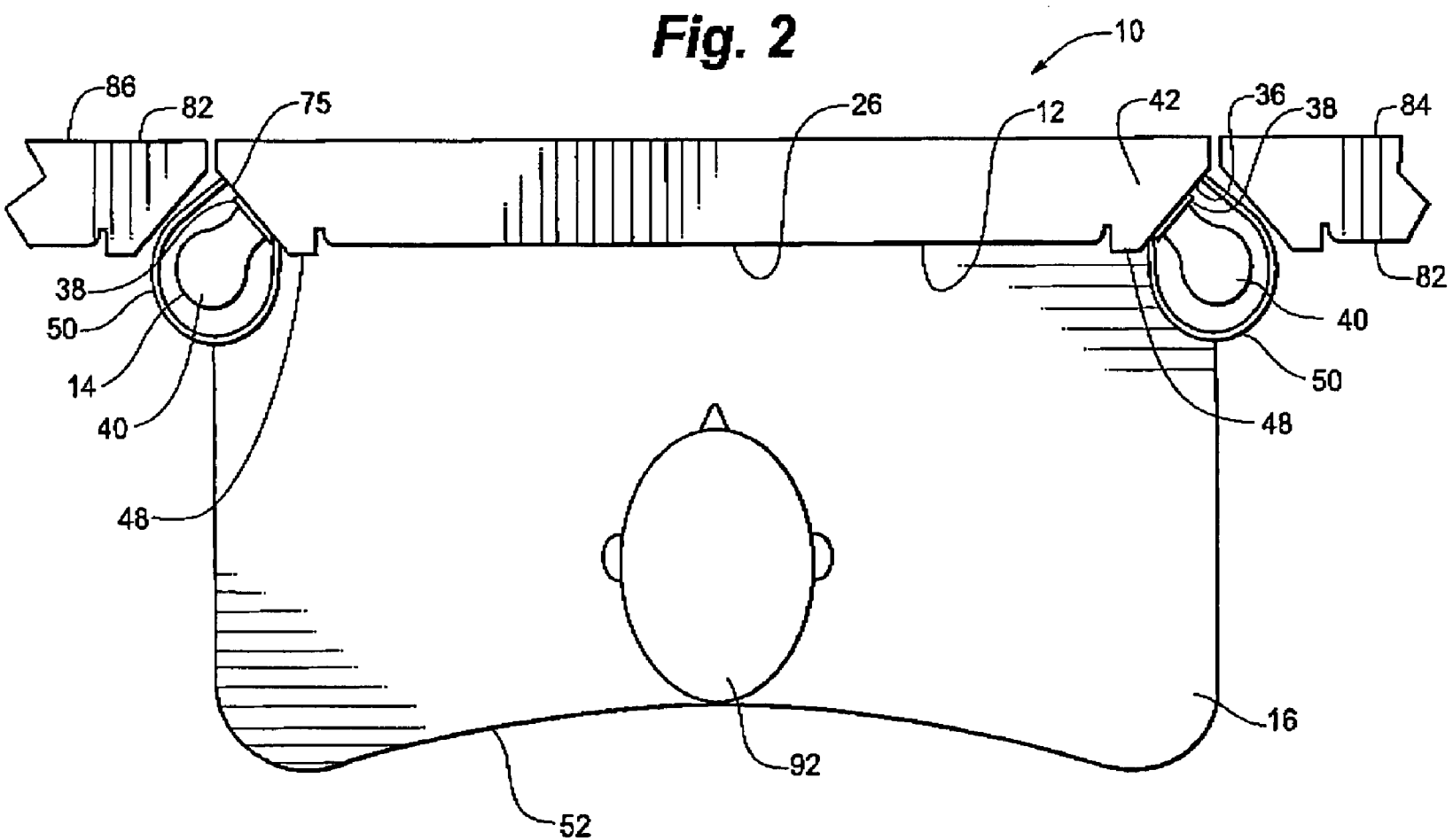
FIG. 2 is a top plan view of the make up station of FIG. 1 with the head of a user schematically depicted and partially depicting additional stations on either side of a central station.
Figure 3:
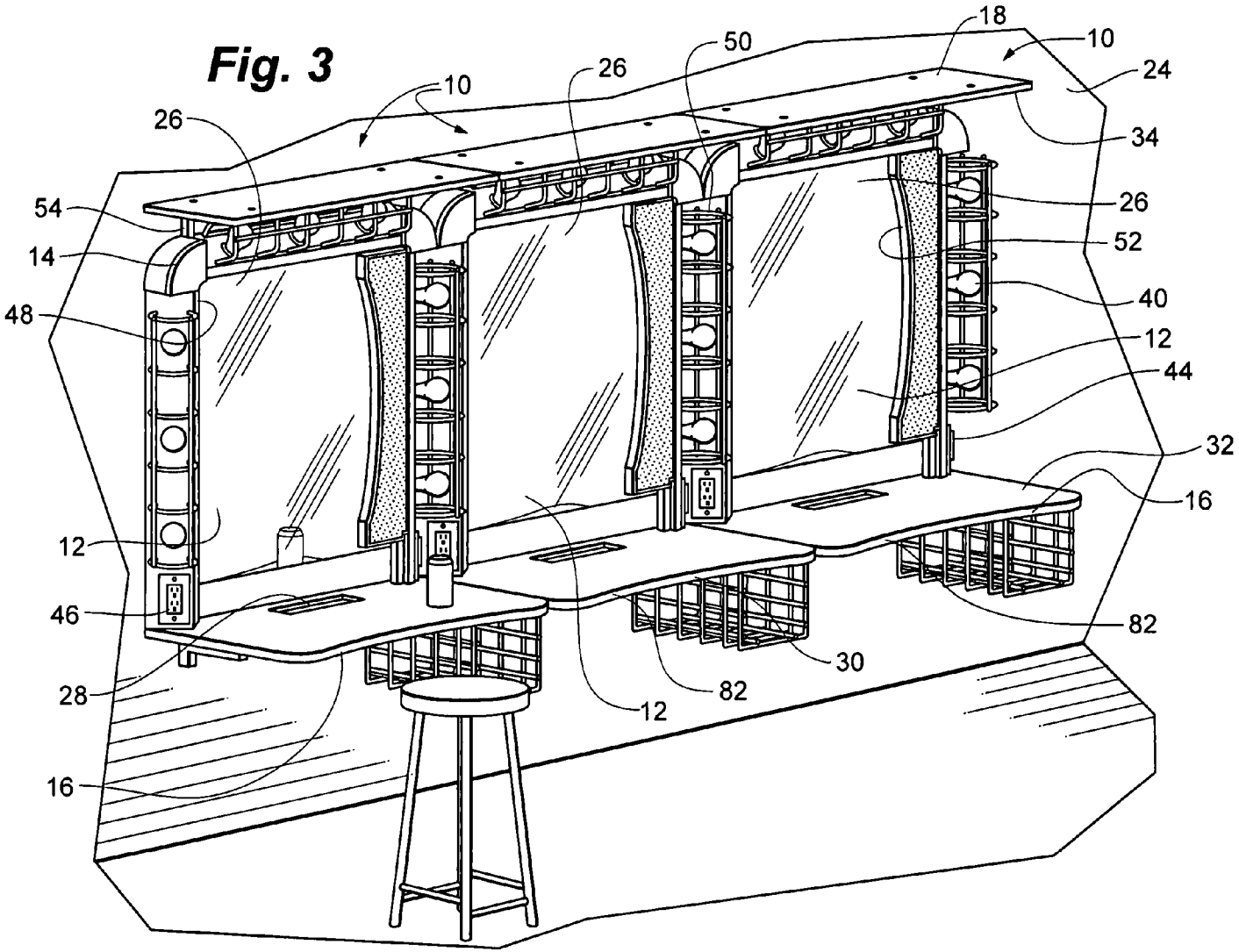
FIG. 3 is a perspective view of the make up station of FIGS. 1 and 2 depicted in conjunction with two additional make up stations installed on a supporting wall in accordance the present invention.
Figure 4:
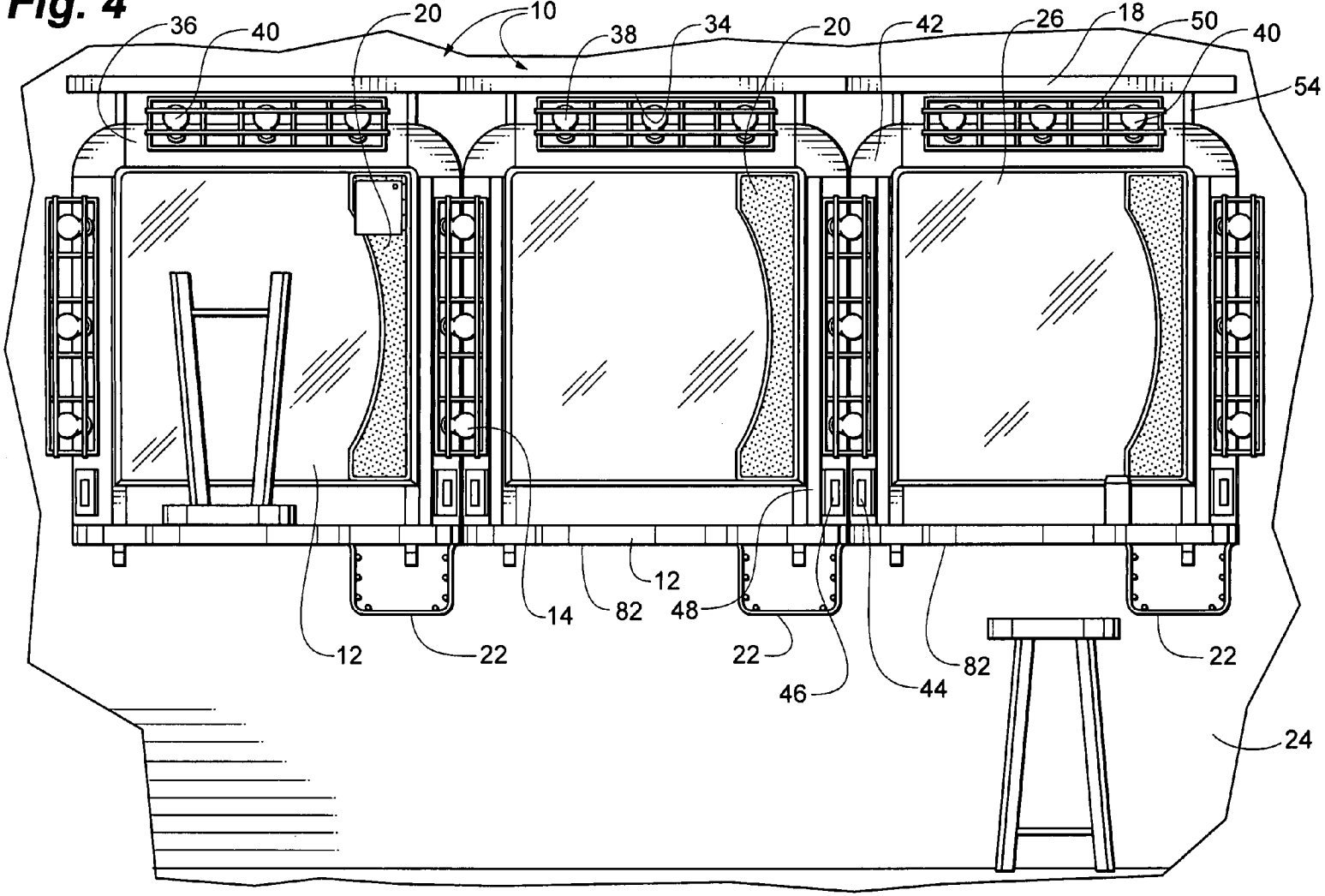
FIG. 4 is a front view of the make up stations as depicted in FIG. 3.

Referring now to FIG. 2, a top view of a make up station 10 of the present invention is shown. The concave front edge 30 of the work surface 16 is depicted. FIG. 2 also shows two adjacent make up stations 10*a* and 10*b* with lampholders 38 and lamps 40 projecting at approximately a 45-degree angle from the frame 36, the three lamps 40 located on the inner side of the first make up station 10 also illuminate the immediately adjacent side of the adjacent make up station 10*a* or 10*b*. This feature reduces the cost of adjacent units and simplifies the installation of multiple adjacent make up station 10. A first unit has nine incandescent lamps while each subsequent adjacent unit requires only six incandescent lamps to achieve the same lighting level for each make up station. FIGS. 3 and 4 shows three make up stations located adjacent each other. Make up station 10 includes nine incandescent lamps, three across the top of the unit and three on each the right and left side. Make up station 10*a* comprises six incandescent lamps, three across the top of the unit and three on the right side. Make up station 10*b* also comprises six incandescent lamps, three across the top of the unit and three on the right side.

Note that switch 44 and duplex outlet 46 are located so that if there are multiple make up stations 10 installed side by side that all the switches 44 are on the same side of each unit in the row. In this fashion a performer located at one of the middle units in the row can turn on the lamps 40 at the make up station 10 directly in front of him as well as the adjacent make up station 10 that supplies light to one side of the make up station 10 directly in front of him without the need to leave his seat.

Figure 5:
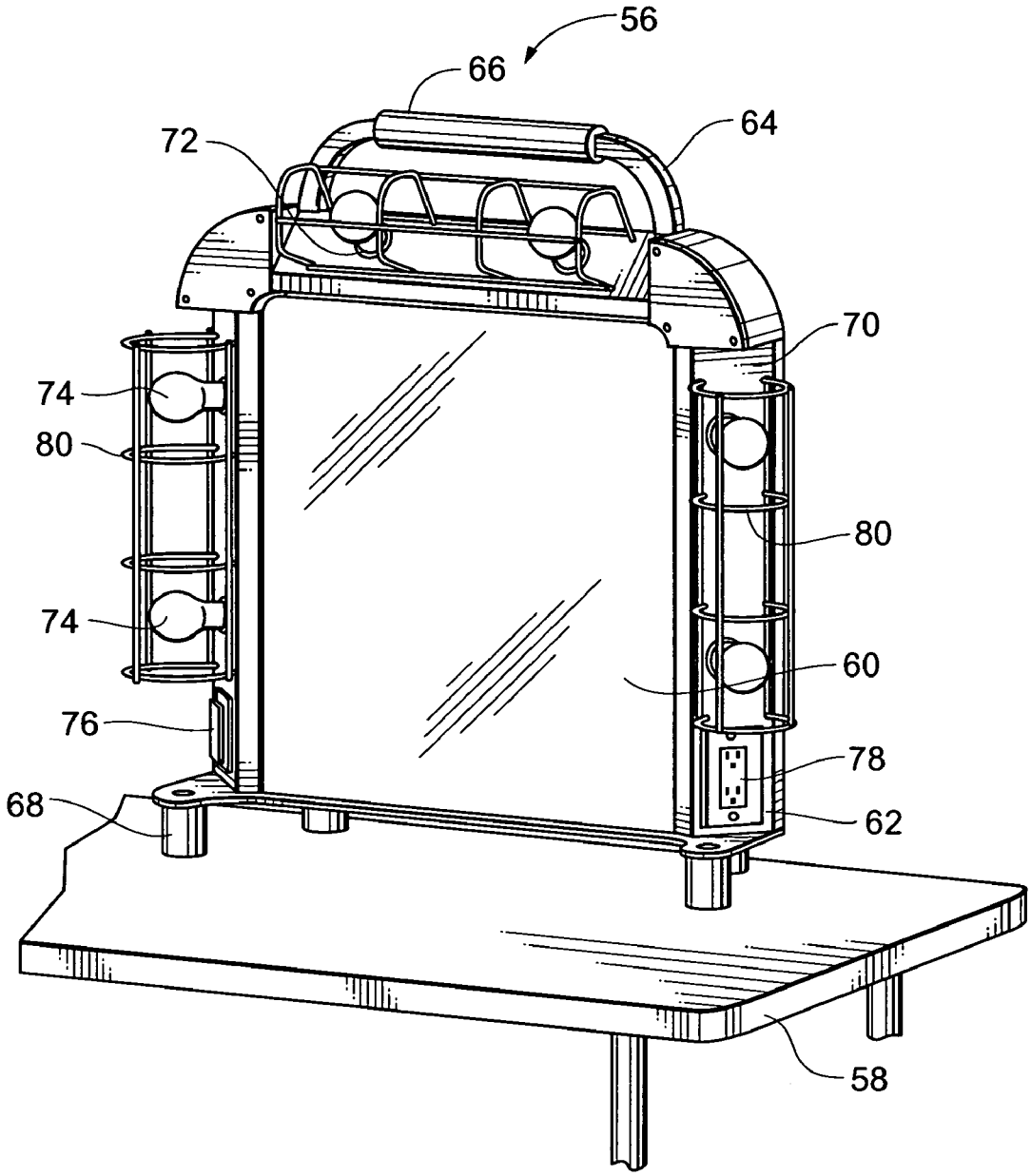
FIG. 5 is a perspective view of a portable make up station placed on a supporting counter top in accordance with a further embodiment of the present invention.

Referring now to FIG. 5, another embodiment, a portable make up station 56 is shown. The portable make up station 56 is similar to the make up station 10 depicted in FIGS. 1–4 and is preferably for tabletop 58 use. The portable station's 56 smaller size and configuration make it easy to transport to temporarily established make up areas or on location. The portable station 56 includes mirror 60, electrical and light system 62, and portable station frame 64. The portable station frame 64 further includes a portable station handle 66 and base supports 68.

The electrical and light system 62 preferably includes a frame 70, lampholders 72, incandescent lamps 74, switch 76, and duplex outlet 78. There are preferably six lampholders 72 with corresponding lamps 74 on each portable make up station 56. The lanipholders 72 preferably project from the frame 70 at about a 45-degree angle. This angle of the lampholders 72 and lamps 74 reduces or eliminates glare from the mirror 60 as is further discussed below. Referring to FIG. 2, electrical raceway 42 forms beveled portion 75.

Referring again to FIG. 5, mirror 60 is recessed slightly into the front surface of portable make up station 56 and surrounded by raised trim 48 similar to make up station 10. Raised trim 48 shields lamps 40 from being imaged in mirror 12 thus minimizing or eliminating undesirable peripheral reflections and glare. Raised trim 48 may be an integral part of frame 36. Frame 36 serves both to form a mirror surround and electrical raceway 42 preferably formed from extruded aluminum. Electrical raceway 42 provides a convenient conduit for running and protecting electrical wiring associated with lampholders 38, switch 44, and duplex outlet 46. Electrical raceway 42 desirably has across sectional shape that approximates a scalene right triangle. Lampholders 38 are supported by the side of electrical raceway 42 that forms the hypotenuse of the triangle. This places incandescent lamps 40 adjacent to but partially behind the plane of mirror 12.

The lamps 74 are enclosed by steel wire cages 80, an N.E.C. requirement. The wire cages 80 are positioned such that they protect the lamps 74 while minimizing shadows cast upon a person's face when using the make up station 56. The switch 76 is operable to control the lampholders 72 and lamps 74, while the duplex outlet 78 provides electrical power for styling accessories such as hairdryers and curling irons.

As can best be seen in FIGS. 2, 3 and 4, adjacent make up stations 82 may be constructed in a right hand version 84 or a left hand version 86. Right hand version 84 includes incandescent lamps 40 and lamp holders 38 along the top edge of mirror 12 and the right hand side of mirror 12. Left hand version 86 includes lamp holders and incandescent lamps 40 along the top of mirror 12 and the left hand side of mirror 12. Combination of make up stations 10 with right hand version 84 and left hand version 86 of adjacent make up stations along a wall surface 24 allow for any number of make up stations 10 to be assembled to provide multiple make up stations without the need for substantial custom construction. It is desirable that either right hand versions 84 or left hand versions 86 but not both be combined with a makeup station 10 so that switches 44 and duplex outlets 46 are located so that if there are multiple make up stations 10 installed side by side all the switches 44 are on the same side of each unit in the row. In this fashion a performer located at one of the middle units in the row can turn on the lamps 40 at the make up station 10 directly in front of him as well as the adjacent make up station 10 that supplies light to one side of the make up station 10 directly in front of him without the need to leave his seat.

Figure 6:
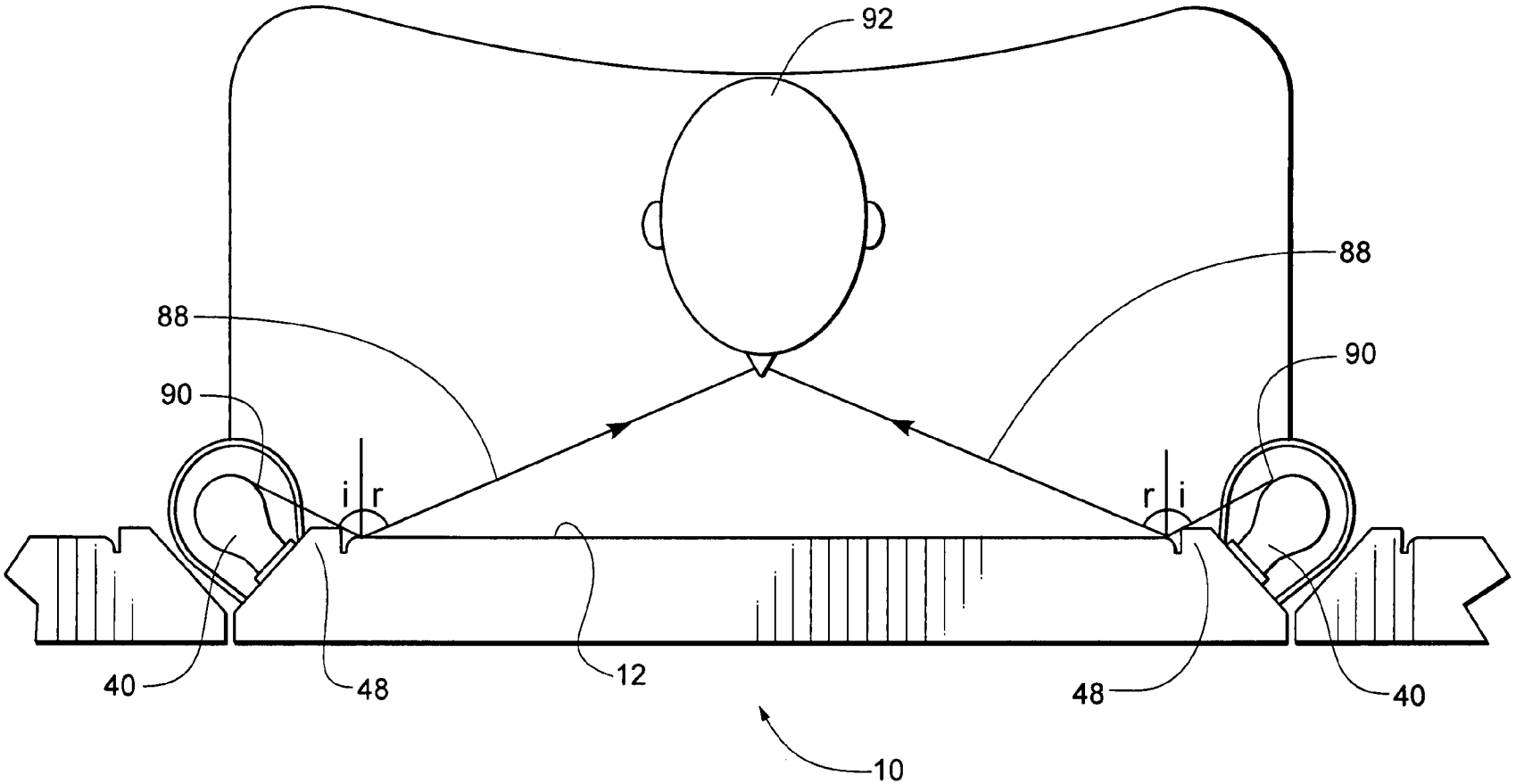
FIG. 6 is a top plan view of a make up station in accordance with the present invention showing incident and reflected light rays reflected from the peripheral edges of the mirror.

Referring to FIG. 6, incandescent lamps 40, raised trim 48 and mirror 12 are positioned relative to one another so that a light ray 88 emanating along a line tangent from the forward most edge 90 of incandescent lamp 40 and not being intercepted by raised trim 48 is reflected by mirror 12 so that it passes in front the eyes of a user 92. In this way the reflected image of incandescent lamp 40 is not visible to user 92 and reflected glare from incandescent lamps 40 reflected in mirror 12 is substantially eliminated while still providing bright and even illumination to the face of user 92. The path of light rays 88 is depicted from above but rays from incandescent lamps 40 above mirror 12 are reflected in a similar fashion and are diffused upon reflection from work surface 16.

As is well known in optics, the law of reflection indicates that the angle of reflection (r) of reflected light rays is equal to the ray's angle of incidence (i). The angles of incidence and reflection, depicted in FIG. 6., are measured from an imaginary line normal to the reflecting surface. Here, lamps 40, 74 are positioned such that light rays emanating from them strike mirror 12 surface at an angle of incidence close to ninety degrees. Thus, the reflected light rays follow an angle of reflection close to ninety degrees that is also at a small acute angle to the mirror surface. Therefore, the reflected image of the lamps can only be seen by placing the viewer's eye very close to the mirror surface. This effectively eliminates the glare and distracting reflected images of lamps 40 or 74 for a user whose head is positioned conventionally in front of the mirror 12 or 60 while still allowing the benefit of having lamps 74 fully exposed to provide illumination in all directions from lamps 40, 74.

In operation, make up station 10 is secured to wall surface 24 by support frame 54. An electrical supply is connected to electrical and light system 14 and make up station 10 is ready for use.

When turned on via switch 44, incandescent lamps 40 provide even illumination at a warm color temperature. Work surface 16 is covered by finish 32 and reflective storage surface 18 has reflective undersurface 34. These reflective surfaces provide additional reflected illumination to illuminate the face of a user at make up station 10. Reflective storage surface 18 and storage unit 22 can be used to store items that are not immediately needed. Trough 28 provides a convenient location to store items that are currently being used such as makeup and styling implements. Duplex outlet 46 is available for connection of appliances such as hairdryers or curling irons. Wire cages 50 protect incandescent lamps 40 from breakage and also protect users of make up station 10 from possible contact with incandescent lamps 40, which get hot in operation.

The positioning and orientation of incandescent lamps 40 in lamp holders 38, supported by electrical raceway 42, places incandescent lamps 40 in a location such that they provide even illumination for a user of make up station 10 without appearing as a reflection in mirror 12. In addition, the positioning of lamp holders 38 and incandescent lamps 40 provides for even partial illumination of any adjacent make up stations 10, when multiple make up stations 10 are orientated on a wall surface 24 in a serial fashion side-by-side. This arrangement includes at least one make up station 10 and at least right hand version 84 or left hand version 86. As can be seen any number of make up stations 10 can be installed adjacent to one another to accommodate as many users simultaneously as desired or needed.

As can be best seen in FIGS. 2 and 3, when multiple make up stations 10 are located side-by-side, only one of make up stations 10 need have incandescent lamps 40 on both vertical sides. Adjacent make up stations 10 have incandescent lamps 40 only along the top and along one side of mirror 12. A single make up station 10 with incandescent lamps 40 on both vertical sides of mirror 12 can be used at an end of a row of make up stations 10 with additional units all having incandescent lamps 40 located on only one side of the mirror 12 or a single make up station 10 with incandescent lamps 40 on both sides of mirror 12 may be place in the middle of a run of make up stations 10 with adjacent make up stations 10 with adjacent make up stations 10 on the right side having incandescent lamps 40 only on the right side of mirror 12 and additional units of make up station 10 on the left side having incandescent lamps 40 only the left side of mirror 12.

This arrangement allows the creation of a series of make up stations 10 side-by-side of any number without the need for custom construction. In addition, incandescent lamps 40 that are located mirrors 12 provide illumination to users on both sides.

Referring to FIG. 5, portable make up station 56 is adapted to sit conveniently on any available tabletop 58. Portable station frame 64 includes and supports portable station handle 66 to allow for easy grasping and transport of portable make up station 56. Base supports 68 support portable make up station 56 on table top 58 in a stable fashion. Portable make up station 56 need only be plugged into an available electrical outlet and switched on via switch 76 in order to provide illumination for a portable make up station 56 user. Portable make up station 56 also includes duplex outlets 78 or a single outlet for convenient connection of make up and styling appliances. Switch 76 and outlet 78 may also be combined into a single assembly. Desirably the outlet 78 included GFCI protection. In addition, wire cages 80 protect incandescent lamps 74 from breakage during handling and transport as well as protecting users from possible burns by coming into contact with incandescent lamps 74.

The present invention may be embodied in other specific forms without departing from the spirit of the essential attributes thereof; therefore, the illustrated embodiments should be considered in all respects as illustrative and not restrictive, reference being made to the appended claims rather than to the foregoing description to indicate the scope of the invention.

What is claimed is:

1. A make up station, comprising:

a generally planar first mirror having a perimeter, the mirror farther displaying an associated angle of incidence and an angle of reflection, the angle of incidence being equal to the angle of reflection and the angle of incidence and the angle of reflection both being defined with reference to a normal to the mirror surface;

a raised barrier surrounding at least a portion of the perimeter of the mirror, an angled side that forms an angle with the plane of the mirror of about forty five degrees; and a light source to illuminate a user before the mirror, the light source being positioned peripheral to the perimeter, the light source being substantially fully exposed and positioned at least partially behind the plane of the mirror such that a ray tangent to the forwardmost portion of the light source traveling along the angle of incidence and not intercepted by the raised barrier and reflecting proximate the perimeter of the mirror and traveling along the angle of reflection does not impinge on a users eye.

2. The make up station as claimed in claim 1, in which the mirror is rectilinear in shape and the light source comprises lamps arranged around three sides of the perimeter of the mirror.

3. The make up station as claimed in claim 2, further comprising a second generally planar mirror and a second light source arranged around the perimeter of the mirror and on two sides thereof such that the first mirror is adjacent the second mirror and the light source on one of the three sides of the first mirror are interposed between the first mirror and the second mirror such that both the first mirror and the second mirror have light sources positioned on three sides thereof.

4. The make up station as claimed in claim 1, further comprising a frame surrounding the mirror on three sides, the frame comprising a generally triangular cross section and having a first side acutely angled with relation to the plane of the mirror and behind the mirror, the first side supporting lamp holders to support the light source.

5. The make up station as claimed in claim 4, in which the frame further comprises an electrical raceway to enclose electrical wiring.

6. A make up station, comprising:

a generally planar first mirror having a perimeter, the mirror further displaying an associated angle of incidence and an angle of reflection, the angle of incidence being equal to the angle of reflection and the angle of incidence and the angle of reflection both being defined with reference to a normal to the mirror surface;

a raised barrier surrounding at least a portion of the perimeter of the mirror;

a wall-mounting bracket comprising a leveling adjustment structure and a horizontal positioning adjustment structure and a light source to illuminate a user before the mirror, the light source being positioned peripheral to the perimeter, the light source being substantially fully exposed and positioned at least partially behind the plane of the mirror such that a ray tangent to the forwardmost portion of the light source traveling along the angle of incidence and not intercepted by the raised barrier and reflecting proximate the perimeter of the mirror and traveling along the angle of reflection does not impinge on a users eye.

7. A make up station, comprising:

a generally planar first mirror having a perimeter, the mirror further displaying an associated angle of incidence and an angle of reflection, the angle of incidence being equal to the angle of reflection and the angle of incidence and the angle of reflection both being defined with reference to a normal to the mirror surface;

a raised barrier surrounding at least a portion of the perimeter of the mirror;

a carrying handle;

base supports; and a light source to illuminate a user before the mirror, the light source being positioned peripheral to the perimeter, the light source being substantially fully exposed and positioned at least partially behind the plane of the mirror such that a ray tangent to the forward most portion of the light source traveling along the angle of incidence and not intercepted by the raised barrier and reflecting proximate the perimeter of the mirror and traveling along the angle of reflection does not impinge on a users eye.

8. A make up station to accommodate multiple users each with an illuminated individual mirror, the make up station comprising:

a plurality of modular rectilinear mirror units arranged generally side by side adjacent one another and each mirror unit having a surround;

the surround of a first of a said mirror units comprising lamps on three sides thereof;

the surrounds of a second of said mirror units comprising lamps on two sides thereof; and the mirror units being arranged such that each modular mirror unit is illuminated on each of three sides thereof; and in which the surrounds of each mirror unit have a beveled portion and the beveled portion of the surround supports the lamps to illuminate users of the mirrors.

9. The make up station as claimed in claim 8, in which the beveled portions and adjacent beveled portions together form a recess that surrounds the lamps on two sides.

10. A method of building a make up station, comprising the steps of:

locating an initial modular mirror unit, the modular mirror unit comprising a rectilinear mirror in a surround with lamps on three sides thereof, locating a second modular mirror unit adjacent the initial mirror unit, the second mirror unit having a surround with lamps on two sides thereof, the second mirror unit being placed adjacent the initial mirror unit so that a side of the second mirror unit having no lamps is placed adjacent a side of the first mirror unit having lamps thereon so that both the first mirror unit and the second mirror unit have lamps on three sides thereof.

11. The method as claimed in claim 10, further comprising the step of:

locating a third modular mirror unit adjacent either the initial modular mirror unit or the second modular mirror unit such that the first mirror unit, the second mirror unit and the third mirror unit have lamps on three sides thereof.

12. The method as claimed in claim 10, further comprising the step of:

locating additional modular mirror units adjacent either a previously placed modular mirror unit such that the initial mirror unit, and all the additional modular mirror units have lamps on three sides thereof.

13. A make up station, comprising:

a rectilinear generally planar mirror having a perimeter with a top edge and two sides;

lamps along said top edge and one of said two sides;

lamp holders to hold said lamps said lampholders being located on the opposite side of plane of the mirror from a viewer viewing his reflection in the mirror and the lampholders being angled relative to the plane of the mirror about forty five degrees such that the lamps are not visible as a reflected image in the mirror to the viewer viewing his image in the mirror while, at the same time, the lamps illuminate the viewer's face.

14. The make up station as claimed in claim 13, further comprising additional lamps along the other of said two sides, the additional lamps being supported by lamp holders along the other of said two sides the lampholders being angled relative to the plane of the mirror such that the lamps are not visible as a reflected image in the mirror to the viewer viewing his image in the mirror while, at the same time, the lamps illuminate the viewer's face.

15. The make up station as claimed in claim 13, further comprising a frame surrounding the mirror on three sides, the frame comprising a generally triangular cross section and having a first side acutely angled with relation to the plane of the mirror and behind the mirror, the first side supporting a lamp holders to support the light source.

16. The make up station as claimed in claim 15, in which the frame further comprises an electrical raceway to enclose electrical wiring.

* * * * *